United States Patent [19]

Oshima et al.

[11] 4,326,822

[45] Apr. 27, 1982

[54] ARTIFICIAL ISLAND FOR INSTALLING OIL DRILLING EQUIPMENT IN ICE COVERED SEA AREAS

[75] Inventors: Masanao Oshima, Tokyo; Nobuyoshi Yashima, Funabashi, both of Japan

[73] Assignee: Mitsui Engineering and Shipbuilding Co., Ltd., Tokyo, Japan

[21] Appl. No.: 97,899

[22] Filed: Nov. 27, 1979

[30] Foreign Application Priority Data

Nov. 30, 1978 [JP] Japan ..... 53-148878
Nov. 30, 1978 [JP] Japan ..... 53-148879

[51] Int. Cl.[3] ..... E02B 17/00
[52] U.S. Cl. ..... 405/217; 405/61
[58] Field of Search ..... 405/217, 61, 15, 18, 405/19, 11, 224

[56] References Cited

U.S. PATENT DOCUMENTS

| | | | |
|---|---|---|---|
| 7,799 | 11/1833 | Easby | 405/11 X |
| 946,841 | 1/1910 | Gilman | 405/11 |
| 3,675,430 | 7/1972 | Haimila | 405/217 |
| 3,886,751 | 6/1975 | Labora | 405/15 X |
| 3,957,098 | 5/1976 | Hepworth et al. | 405/19 X |
| 4,012,917 | 3/1977 | Gendron | 405/224 X |
| 4,080,798 | 3/1978 | Reusswig et al. | 405/217 |
| 4,242,012 | 12/1980 | Utt | 405/217 |

FOREIGN PATENT DOCUMENTS

| | | | |
|---|---|---|---|
| 972975 | 8/1975 | Canada | 405/217 |
| 632799 | 11/1978 | U.S.S.R. | 405/211 |

*Primary Examiner*—Dennis L. Taylor
*Attorney, Agent, or Firm*—Armstrong, Nikaido, Marmelstein & Kubovcik

[57] ABSTRACT

An artificial island for installing oil drilling equipment in ice covered sea areas, comprising barricades against ice which surround oil drilling equipment installed in ice covered sea-water and whose respective top portions are projected above the surface of the sea-water, means provided at the bottom portions of the barricades so as to fix them to the sea-bottom, and inclined ice breaking walls provided at the outer sides of the barricades.

18 Claims, 15 Drawing Figures

ARTIFICIAL ISLAND FOR INSTALLING OIL DRILLING EQUIPMENT IN ICE COVERED SEA AREAS

BACKGROUND OF THE INVENTION

1. Field of the Invention

This invention relates to an artificial island for installing oil drilling equipment in ice covered sea areas, which is particularly suitable for installing such equipment in a comparatively shallow ice covered sea area of not more than twenty meters in depth.

2. Description of the Prior Art

In an ice covered sea area, such as the Arctic Ocean, the depth of water is comparatively small or not more than 20 m, and the fast ice in such a sea area is said to be moved approximately 20 m at most during the winter months.

When an oil drilling operation is conducted in such an ice covered sea area, great quantities of sand and gravel are accumulated to form an artificial island on which oil drilling equipment is then installed, or oil drilling equipment is installed directly on the fast ice without forming such an artificial island.

However, it is necessary that the area of an artificial island to be formed in an ice-covered sea area for oil drilling operation be considerably large since the artificial island has to be capable of withstanding floating ice or a high ice pressure. It takes a long period of time and great cost to build an artificial island of a large area. Moreover, it is very difficult to remove such an artificial island after an oil drilling operation has been completed. It therefore costs a great deal to remove an artificial island built in such a sea area. In addition, removing an artificial island causes environmental pollution.

Setting an oil drilling installation directly on the fast ice is limited to one or two months in the depth of winter, in which the fast ice is not moved to a large degree. Moreover, drill breakage is possible during an oil drilling operation due to the movement of the ice.

SUMMARY OF THE INVENTION

An object of the present invention is to provide an artificial island for installing oil drilling equipment in ice covered sea areas, particularly suitable for installing oil drilling equipment in comparatively shallow ice covered sea areas of not more than twenty meters in depth.

Another object of the present invention is to provide an artificial island for installing oil drilling equipment in ice covered sea areas, which can be formed in a short period of time and which can be removed easily.

Still another object of the present invention is to provide an artificial island for installing oil drilling equipment in ice covered sea areas, which is free from problems of environmental pollution.

A further object of the present invention is to provide an artificial island for installing oil drilling equipment in ice covered sea areas, which permits an oil drilling operation for a long period of time in all seasons.

To these ends, the present invention provides an artificial island for installing oil drilling equipment in ice covered sea areas, which comprises at least one barricade against ice which is disposed such that the top portion thereof projects above the surface of the sea water and which surrounds the oil drilling equipment, and an inclined ice breaking wall formed on the outer side of the barricade, which is opposite to that side thereof which faces the oil drilling equipment.

The above and other objects as well as advantageous features of the invention will become clear from the following description of preferred embodiments taken in conjunction with the accompanying drawings.

DESCRIPTION OF PREFERRED EMBODIMENTS

Figure 1:
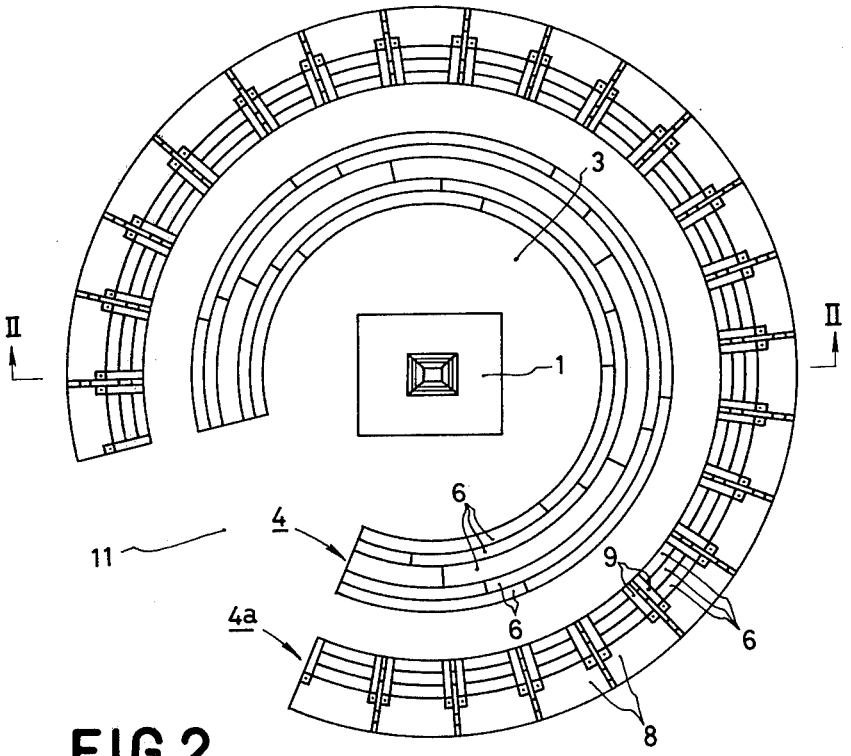
FIG. 1 is a plan view of an artificial island embodying the present invention.
Figure 2:
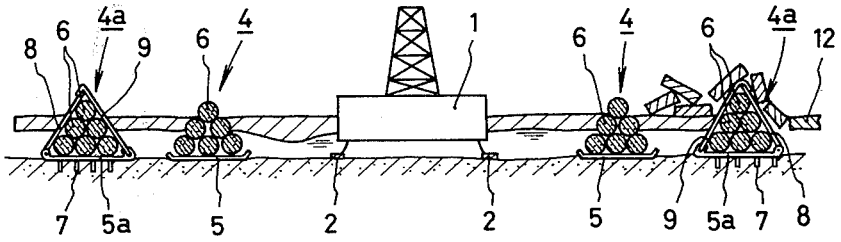
FIG. 2 is a longitudinal sectional view taken along the line II—II in FIG. 1.

Referring to FIGS. 1 and 2, reference numeral 1 denotes oil drilling equipment held by anchors 2 lowered therefrom in a comparatively shallow ice covered sea area 3 of not more than 20 m in depth. Inner and outer barricades 4, 4*a* against ice are disposed such as to surround the oil drilling equipment 1. Each of the barricades 4, 4*a* contacts the sea-bottom at the lower end surface thereof and is projected beyond the surface of the sea area 3 at the top portion thereof. The inner barricade 4 consists of a base plate 5 laid on the sea-bottom, and a plurality of sand packed tubes 6 piled up on the base plate 5. The sand packed tubes 6 are piled up such that the number thereof on the sea-bottom side is greater than that thereof on the side of the surface of the sea water. Accordingly, the piled sand packed tubes 6 as a whole are sectionally in the shape of a downwardly diverged equilateral triangle. The piled sand packed tubes as a whole may be substantially trapezoidal with its longer horizontal side on the side of the sea-bottom. Each of the sand packed tubes 6 consists of, as will be described in detail later, a flexible container tube and sand packed therein under pressure.

That portion of the barricade 4 which is projected beyond the surface of the sea water is so high that the wind and waves cannot easily override the same.

The outer barricade 4*a* is disposed such that it surrounds the inner barricade 4 in a slightly spaced manner. The outer barricade 4*a* consists of, just as the inner barricade 4, a base plate 5*a* laid on the sea-bottom, and a plurality of sand packed tubes 6 piled up on the base plate 5*a*. The base plate 5*a* is provided with a plurality of projections 7 fixed to the lower surface thereof. The projections 7 are inserted into the sea-bottom to serve as fixing means for the barricade 4*a*.

The barricade 4*a* is provided with a diagonally fixed ice breaking wall 8 at the outer side thereof which is opposite to that side thereof which faces the oil drilling equipment 1. A frame 9 for supporting the ice breaking wall 8 is provided on that side of the barricade 4*a* which faces the oil drilling equipment 1.

Figure 3:
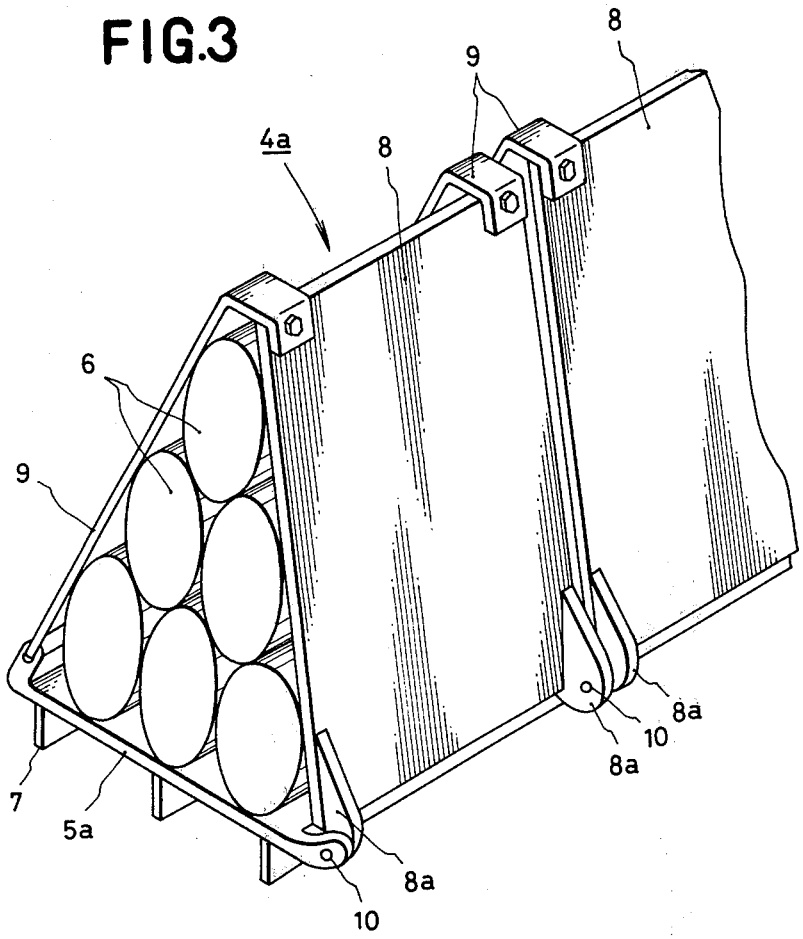
FIG. 3 is a perspective view of a part of a barricade against ice in the embodiment shown in FIG. 1.

FIG. 3 illustrates the outer barricade 4*a* in detail.

The inclined ice breaking wall 8 is pivotally connected at its flanges 8*a* at the lower end portion thereof to one end portion of the base plate 5*a* with pins 10. The wall 8 is fixedly connected at one end portion thereof to the support frame 9 such that the wall 8 is at a predetermined angle to the bottom surface of the barricade 4*a*. The support frame 9 is fixed at the lower end portion thereof to the outer end portion of the base plate 5.

The support frame 9 also serves to protect the sand packed tubes 6 piled up between the frame 9 and the ice breaking wall 8. The ice breaking wall 8 is inclined preferably at an angle of 30°–65° with respect to the horizontal surface of the sea water.

The inner and outer barricades 4,4*a* do not surround the entire circumference of the oil drilling equipment 1. Namely, the barricades 4,4*a* have an interrupted portion 11, which is useful for introducing oil drilling equipment 1 therethrough to the space inside the inner barricade 4 so as to be set up in the space after the barricades 4,4*a* have been formed. It is necessary that the interrupted portion 11 be provided on the downstream side, not on the upstream side, of the floating ice. The barricades 4,4*a* disposed in the above-described manner not only facilitate the introduction of the oil drilling equipment 1 into the space inside the inner barricade 4 so as to be set up therein but also preventing the entry of ice into the above-mentioned space during an oil drilling operation.

If the condition of the ice covered sea area permits, an interrupted portion 11 may not be provided or the barricades 4,4*a* may surround the whole circumference of the oil drilling equipment 1. It is desirable that the barricades against ice be provided doubly or more but only one barricade may be serviceable.

Floating ice 12 running toward an artificial island of the above-described construction as shown in FIG. 2 has a low resistance to bending force. The floating ice 12 colliding the inclined ice breaking wall 8 is bent and broken into pieces to override the outer barricade 4*a* and drop into a space between the inner and outer barricades 4,4*a*. When the floating ice 12 collides with the outer barricade 4*a*, a great pressing force is exerted thereon. Therefore, it is necessary that the projections 7 at the lower surface of the outer barricade 4*a* be designed such that the projections 7 are sufficiently resistant to such pressing force of the floating ice. In order to give a sufficient resistance to the projections 7, means as shown in FIGS. 4–6 may be additionally provided.

Figure 4:
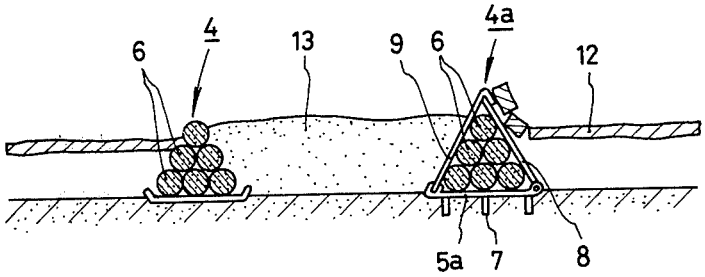
FIG. 4 is a longitudinal sectional view of the inner and outer barricades against ice shown in FIG. 1, between which a kind of material for preventing the barricades from being moved is inserted.

FIG. 4 shows sand or gravel 13 accumulated in the space between the inner and outer barricades 4,4*a* so as to prevent the outer barricade 4*a* from being moved.

Figure 5:
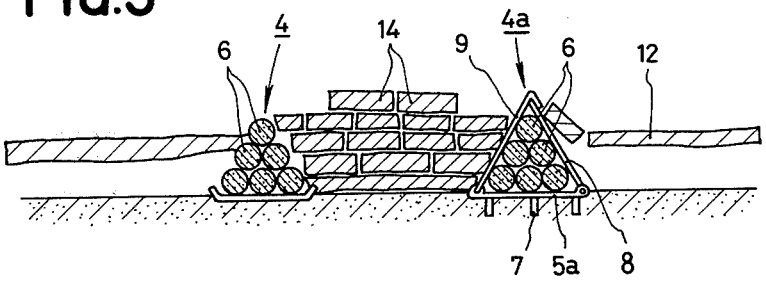
FIG. 5 is a longitudinal sectional view of the inner and outer barricades against ice shown in FIG. 1, between which another kind of material for preventing the barricades from being moved is inserted.

FIG. 5 shows a plurality of ice blocks 14 piled up in the space between the inner and outer barricades 4,4*a* so as to prevent the outer barricade 4*a* from being moved.

Figure 6:
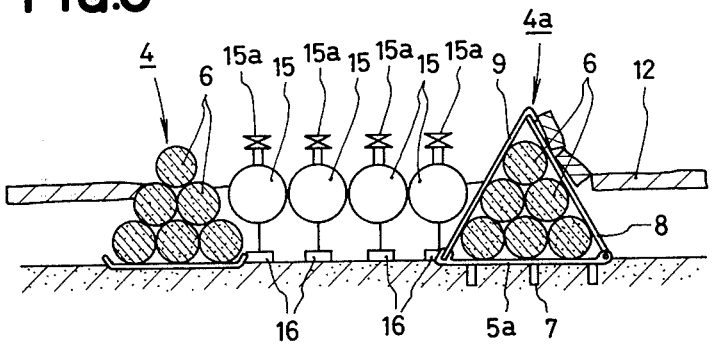
FIG. 6 is a longitudinal sectional view of the inner and outer barricades against ice shown in FIG. 1, between which still another kind of material for preventing the barricades from being moved is inserted.

FIG. 6 shows a plurality of flexible air-containing tubes 15 contacting one another, having pressure regulator valves 15*a*, and floating on and covering the surface of the sea water between the inner and outer barricades 4,4*a*. Reference numeral 16 denotes anchors for holding the flexible air-containing tubes 15. Since the surface of the sea water between the inner and outer barricades 4,4*a* is prevented from contacting the atmosphere due to the tubes 15, the sea water in the mentioned area is not allowed to freeze. Therefore, the tubes 15 can be moved freely.

When the outer barricade 4*a* is slightly moved toward the inner barricade 4 by a pressing force of floating ice, the air-containing tubes 15 is deformed in a collapsed state to absorb the movement of the outer barricade 4*a*. As a result, the pressing force of floating ice does not reach the inner barricade 4. When the outer barricade 4*a* is further moved to a great extent, the air in the tubes 15 comes out therefrom through the pressure regulator valves 15*a* so that the tubes 15 are greatly deformed. Consequently, the inner barricade 4 is not influenced by the pressing force of floating ice.

The sand packed tubes 6 referred to in the previous paragraphs are formed in the following manner.

Figure 7:
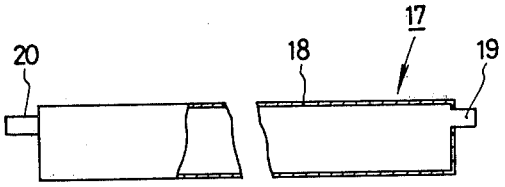
FIG. 7 is a plan view partially in section of a type of a container tube for packing and therein to constitute a part of a barricade shown in FIG. 3.

It is necessary that tubes for packing sand be capable of retaining sand therein and permeating water therethrough. A tube 17 shown in FIG. 7 consists of a cylindrical, elongated, flexible bag 18 coated with a resin so as not to allow water to permeate therethrough; a sand slurry injection port 19 provided at one end portion of the bag 18; and a water discharge port 20 provided at the other end portion thereof. When a sand slurry is injected into the injection port 19 at a predetermined pressure, sand only is deposited in the bag 18 and water is discharged from the discharge port 20 to form a sand packed tube 6.

Figure 8:
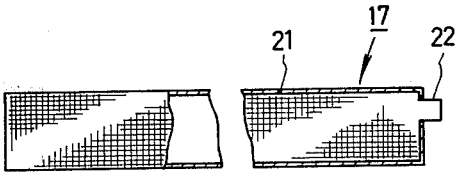
FIG. 8 is a plan view partially in section of another type of container tube for packing sand therein.

A tube 17 shown in FIG. 8 consists of a cylindrical, elongated, flexible bag 21 made of fabric; and a sand slurry injection port 22 provided at one end portion of the bag 21. The fabric is of a porous structure which permits water to be permeated therethrough but which does not permit sand to permeate therethrough. When a sand slurry is injected into the injection port 22 at a predetermined pressure, water is discharged through the bag 21, while sand is deposited therein to form a sand packed tube 6.

Figure 9:
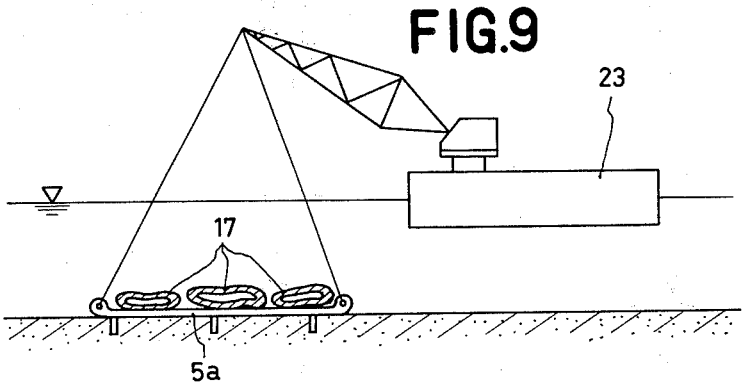
FIG. 9 illustrates a step of laying empty container tubes on a base plate.
Figure 10:
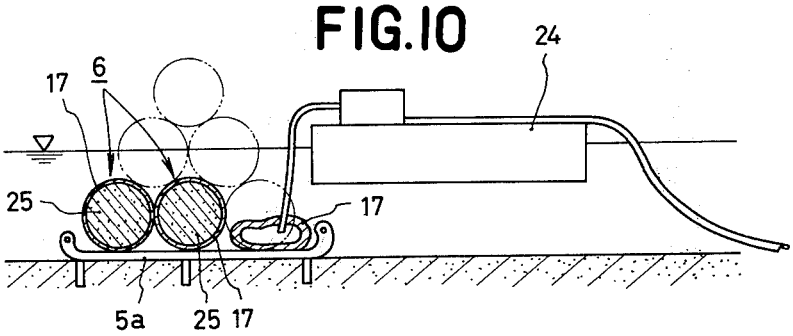
FIG. 10 illustrates a step of injecting a sand slurry into the container tubes shown in FIG. 9.

In order to build barricades against ice having sand packed tubes 6 therein in an ice covered sea area, empty tubes 17 forming the lowest rows of sand packed tubes are laid on a base plate 5*a* as shown in FIG. 9, and the resulting base plate 5*a* is lowered to a predetermined position on the sea-bottom by using a floating crane 23. A sand slurry is then injected under pressure into these empty tubes 17 by using a sand slurry supply boat 24 as shown in FIG. 10, to form tubes 6 in which sand 25 is packed.

After the lowest rows of sand packed tubes 6 have been formed, empty tubes forming the next rows of sand packed tubes are laid thereon to fill them with a sand slurry in the same manner as the manner described. The second rows of sand packed tubes are thus formed. When the final row of sand packed tubes has been formed, an inclined ice breaking wall 8 and a frame 9 for supporting the ice breaking wall 8 are attached to at least the outermost barricade against ice.

According to the present invention, structures are formed around only a part of the circumference of the oil drilling equipment in the above-described manner. Therefore, unlike a conventional artificial island which is formed by accumulating sand or gravel in ice covered sea waters of a large area, an artificial island according to the present invention can be formed with an extremely small amount of sand or gravel in a short period of time. In addition, it is self-evident that an artificial island according to the present invention can be removed very easily.

Figure 11:
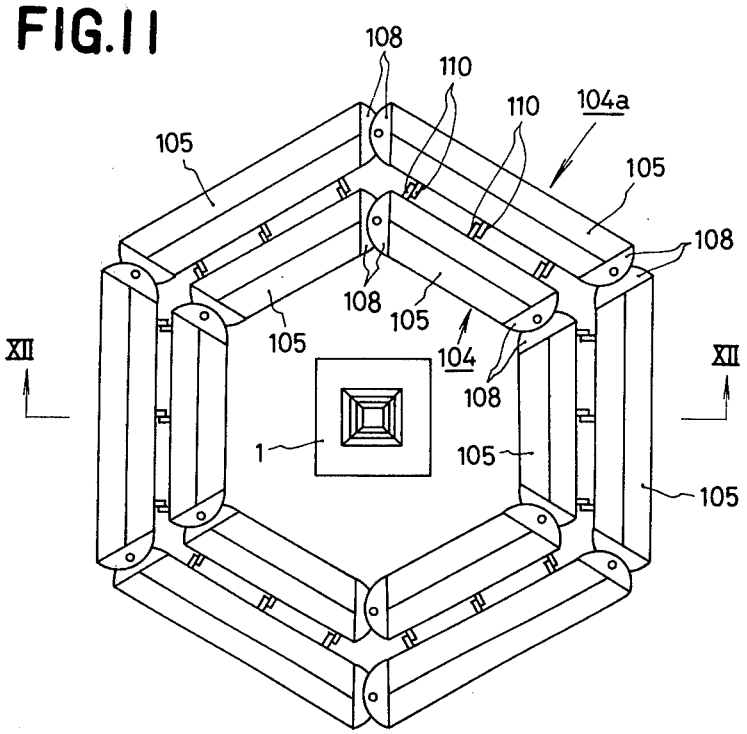
FIG. 11 is a plan view of another embodiment of the artificial island of the present invention.
Figure 12:
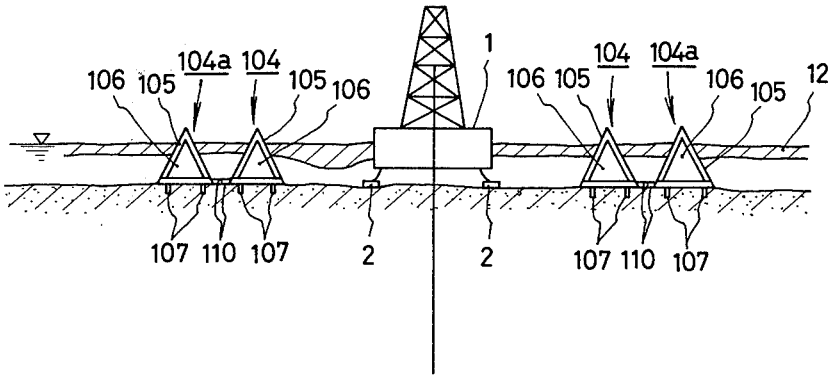
FIG. 12 is a longitudinal sectional view taken along the line XII—XII in FIG. 11.

FIGS. 11 and 12 show another embodiment of the present invention.

Figure 13:
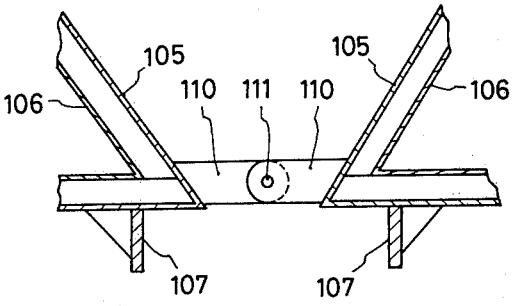
FIG. 13 is a longitudinal sectional view of joint portion of the inner and outer barricades against ice in the embodiment shown in FIG. 11.

In this embodiment, inner and outer barricades against ice 104, 104*a* are provided around oil drilling equipment 1. Each of the barricades 104, 104*a* basically consists of a cross-sectionally triangular, elongated, box type shell 105 made of steel or ferro-concrete; and a ballast tank 106. The shell 105 is provided on the lower surface thereof with a plurality of projections 107 inserted into the sea-bottom as fixing means. The length of the shell 105 forming the inner barricade 104 is smaller than that of the shell 105 forming the outer barricade 104*a*. The outer shell 105 has joints 108 at both end portions thereof. A plurality of shells 105 are circularly connected at the joints 108 to one another with pins 109. Other joints 110 are provided between the parallel-disposed inner and outer shells 105 and connected together with pins 111 as shown in FIG. 13.

It is not strictly necessary that the inner and outer barricades 104, 104*a* surround the whole of the circumference of oil drilling equipment 1. Namely, the inner and outer barricades 104, 104*a* may have an interrupted portion as in the embodiment shown in FIG. 1. It is necessary that such an interrupted portion be provided on the downstream side of floating ice and that an ice breaking wall be simultaneously provided on the upstream side of floating ice. An artificial island according to the present invention may have a single barricade against ice unlike the embodiment described above which is provided with two concentrically arranged barricades. However, it is desirable that at least two rows of barricades be provided.

The inclined outer walls of the cross-sectionally triangular shells 105 of the outermost barricade serve as ice breaking walls. In order that the outer walls of the shells 105 may work sufficiently as ice breaking walls, they are preferably inclined at 30°–65° with respect to the surface of the sea water. Floating ice 12 collides with the outermost wall of the barrier to be bent upwardly and broken into pieces. The broken pieces of floating ice are then dropped into a space between the inner and outer barricades 104, 104*a*.

Figure 14:
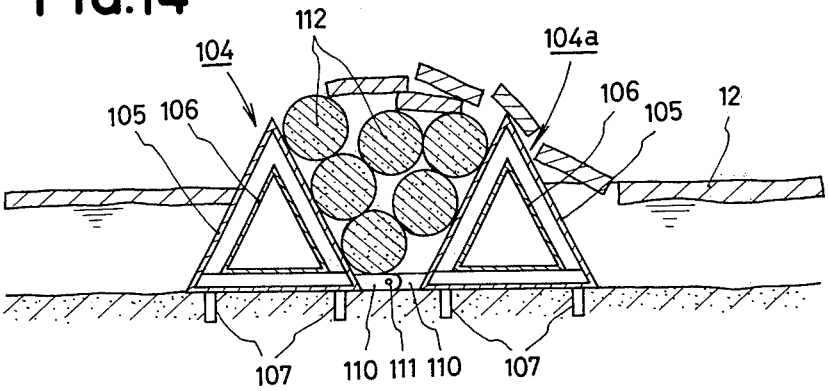
FIG. 14 is a longitudinal sectional view of the inner and outer barricades in the embodiment shown in FIG. 11, between which a kind of material for preventing the barricades from being moved is inserted.

A plurality of projections 107 provided on the lower surface of the barricades 104, 104*a* are inserted into the sea-bottom so as to prevent the barricades 104, 104*a* from being moved by the pressing force of the floating ice 12. Sand packed tubes 112 may be accumulated in the space between the inner and outer barricades 104, 104*a* as in the embodiment shown in FIG. 14, to reliably prevent the barricades from being moved. In order to prevent the movements of the barricades 104, 104*a*, means as illustrated in FIGS. 4–6 may, of course, be provided therebetween instead of sand packed tubes 112.

Figure 15:
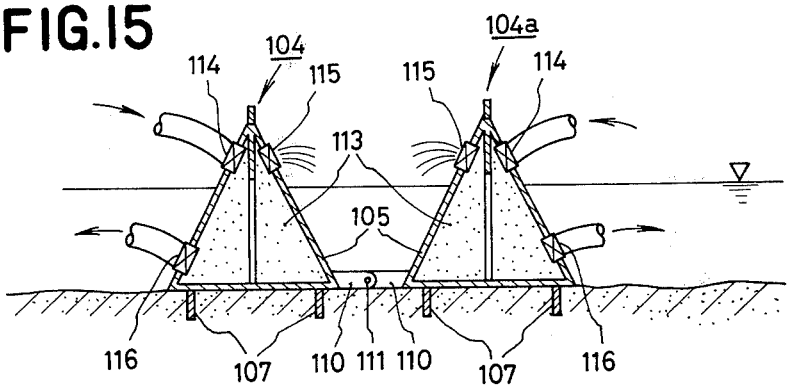
FIG. 15 is a longitudinal sectional view of another type of inner and outer barricades against ice.

The ballast tanks 106 give a weight to the barricades 104, 104*a* to fix the same to the sea-bottom via the projections 107. Sand 113 instead of the ballast tanks 106 may be put in the shells 105 as shown in FIG. 15. The packing of sand 113 in the shells 105 is conducted by preparing a slurry of sand on the sea-bottom, and injecting the slurry under pressure into each shell 105 from an inlet 114 while discharging from an outlet sea water separated from the sand 113.

When the barricades are removed after an oil drilling operation has been completed, the sea water only is injected under pressure into the inlet 114 so that the sand 113 can be discharged with the sea water from another discharge outlet provided at the lower portion of each barricade.

An artificial island according to the present invention as described above is suitably used for an oil drilling operation conducted in a comparatively shallow ice covered sea area of not more than 20 m in depth. In this artificial island, barricades against ice, which constitute the main part thereof, are formed around a limited portion of the circumference of oil drilling equipment, and it is unnecessary unlike a conventional artificial island that sand or gravel be accumulated in a large area. Therefore, an artificial island according to the present invention can be formed at a low cost in a short period of time and removed very easily. Consequently, no problems of environmental pollution are raised.

Since the fast ice in that portion of the ice covered sea area which is surrounded by the barricades is always kept in a stable condition, an oil drilling operation can be conducted in such a sea area in all seasons.

The present invention is not, of course, limited to the above-described embodiments but may be modified in various ways within the scope of the appended claims.

What is claimed is:

1. An artificial island for installing oil drilling equipment in ice covered sea areas, comprising at least two rows of ice barricades for surrounding at least a portion of oil drilling equipment in ice covered sea water, the top portion of each said barricades projecting above the surface of the sea water, means provided at the bottom portion of at least the outermost one of said barricades to fix said barricade to the sea-bottom, and inclined ice breaking wall means provided at a side of at least the outermost one of said barricades which is opposite the side of said barricade which faces the oil drilling equipment, wherein said rows of barricades are separated from one another such that a space is formed therebetween, said space receiving at least a portion of the ice broken by said inclined ice breaking walls.

2. An artificial island for installing oil drilling equipment in ice covered sea areas according to claim 1, wherein each of said barricades is formed by a plurality of piled sand packed tubes.

3. An artificial island for installing oil drilling equipment in ice covered sea areas according to claim 1, wherein each of said barricades is formed by a plurality of piled sand packed tubes laid on a base plate set on the sea-bottom.

4. An artificial island for installing oil drilling equipment in ice covered sea areas according to claim 1, wherein each of said barricades is formed by a plurality of tubes containing sand therein and piled in layers, each of which tubes consists of an elongated bag made of water-permeable fabric.

5. An artificial island for installing oil drilling equipment in ice covered sea areas according to claim 1, wherein each of said barricades is formed by a plurality of tubes containing sand therein and piled in layers, each of which tubes consists of an elongated, water-impermeable, flexible bag having a sand slurry injection port at one end portion thereof and a water discharge port at the other end portion thereof.

6. An artificial island for installing oil drilling equipment in ice covered sea areas according to claim 1, wherein each of said barricades consists of a box structure made of steel plates and containing ballast tanks therein, a part of the side walls of said barricades serving as an inclined ice breaking wall means.

7. An artificial island for installing oil drilling equipment in ice covered sea areas according to claim 1, wherein each of said barricades consists of a box structure made of steel plates and containing sand therein, a part of the side walls of said barricades serving as an inclined ice breaking wall means.

8. An artificial island for installing oil drilling equipment in ice covered sea areas according to claim 1, wherein each of said barricades consists of a box structure made of ferro-concrete and containing ballast tanks therein, a part of the side walls of said barricades serving as an inclined ice breaking wall means.

9. An artificial island for installing oil drilling equipment in ice covered sea areas according to claim 1, wherein each of said barricades consists of a box structure made of ferro-concrete and containing sand therein, a part of the side walls of said barricades serving as an inclined ice breaking wall means.

10. An artificial island for installing oil drilling equipment in ice covered sea areas according to claim 1, wherein each of said barricades has a substantially triangular cross section at right angles to the longitudinal direction thereof, the base of the triangular cross section being put on the side of the sea-bottom.

11. An artificial island for installing oil drilling equipment in ice covered sea areas according to claim 1, wherein each of said barricades has a substantially trapezoidal cross section at right angles to the longitudinal direction thereof, the base of the trapezoidal cross section being put on the side of the sea-bottom.

12. An artificial island for installing oil drilling equipment in ice covered sea areas according to claim 1, wherein adjacent two of said barricades are provided with sand packed bags or tubes accumulated therebetween.

13. An artificial island for installing oil drilling equipment in ice covered sea areas according to claim 1, wherein adjacent two of said barricades are provided with sand or gravel accumulated therebetween.

14. An artificial island for installing oil drilling equipment in ice covered sea areas according to claim 1, wherein adjacent two of said barricades are provided with ice blocks accumulated therebetween.

15. An artificial island for installing oil drilling equipment in ice covered sea areas according to claim 1, wherein adjacent two of said barricades are provided therebetween with a plurality of flexible air-containing tubes which cover the surface of the sea-water between said barricades.

16. An artificial island for installing oil drilling equipment in ice covered sea areas according to claim 1, wherein said ice breaking wall means has an angle of inclination of 30°–65° with respect to the surface of the sea-water.

17. An artificial island for installing oil drilling equipment in ice covered sea areas according to claim 1, wherein said fixing means consist of a plurality of projections extended into the sea-bottom.

18. An artificial island for installing oil drilling equipment in ice covered sea areas according to claim 1, wherein said barricades surrounding oil drilling equipment are disposed at least on the upstream side of floating ice.

* * * * *